US009724714B2

(12) United States Patent
Kakuta

(10) Patent No.: US 9,724,714 B2
(45) Date of Patent: Aug. 8, 2017

(54) FOAM DISCHARGE DEVICE

(71) Applicant: Yoshiyuki Kakuta, Tokyo (JP)

(72) Inventor: Yoshiyuki Kakuta, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/763,372

(22) PCT Filed: Nov. 22, 2013

(86) PCT No.: PCT/JP2013/081517
§ 371 (c)(1),
(2) Date: Jul. 24, 2015

(87) PCT Pub. No.: WO2014/119102
PCT Pub. Date: Aug. 7, 2014

(65) Prior Publication Data

US 2015/0352580 A1 Dec. 10, 2015

(30) Foreign Application Priority Data

Jan. 31, 2013 (JP) ..... 2013-017573

(51) Int. Cl.
*B05B 11/00* (2006.01)
*B05B 7/00* (2006.01)

(52) U.S. Cl.
CPC ..... *B05B 11/3087* (2013.01); *B05B 7/0018* (2013.01); *B05B 7/0031* (2013.01);
(Continued)

(58) Field of Classification Search
CPC ..... B05B 11/3001; B05B 11/3047; B05B 11/3087; B05B 7/0018; B05B 7/0031
See application file for complete search history.

(56) References Cited

U.S. PATENT DOCUMENTS 5,348,189 A * 9/1994 Cater ..... B05B 7/0031 222/1
5,992,703 A 11/1999 Fuchs
(Continued)

FOREIGN PATENT DOCUMENTS

CN 1956797 A 5/2007
CN 102673902 A 9/2012
(Continued)

OTHER PUBLICATIONS

Mar. 4, 2014 International Search Report issued in International Patent Application No. PCT/JP2013/081517.
(Continued)

*Primary Examiner* — Frederick C Nicolas
*Assistant Examiner* — Bob Zadeh
(74) *Attorney, Agent, or Firm* — Oliff PLC

(57) ABSTRACT

In a foam discharge device, a pump has a piston for a liquid linked to a stem, a cylinder for a liquid in which the piston for a liquid is vertically slidably accommodated, a piston for air linked to the stem, a cylinder for air in which the piston for air is vertically slidably accommodated, and an air-liquid mixing unit to mix a liquid from the cylinder for a liquid and air from the cylinder for air to foam the liquid, the cylinder for air is inside a mounting cap and accommodated in a container main body, a head-section-side cylinder for air into which a piston tube erected at a ceiling wall section of the mounting cap is fitted extends from a pressing head, and a communication path to bring the insides of the head-section-side cylinder for air and the cylinder for air in communication is formed at the pump.

10 Claims, 9 Drawing Sheets

(52) U.S. Cl.
CPC ..... *B05B 11/0064* (2013.01); *B05B 11/0075* (2013.01); *B05B 11/3001* (2013.01); *B05B 11/3047* (2013.01)

(56) References Cited

U.S. PATENT DOCUMENTS

| | | | | |
|---|---|---|---|---|
| 6,840,408 | B1 * | 1/2005 | Foster | B05B 11/3074 222/190 |
| 2012/0234866 | A1 * | 9/2012 | Lin | B05B 11/3087 222/190 |
| 2013/0313285 | A1 * | 11/2013 | Iizuka | A47K 5/14 222/190 |
| 2015/0001254 | A1 * | 1/2015 | Uehira | B05B 11/3001 222/321.9 |
| 2015/0352580 | A1 * | 12/2015 | Kakuta | B05B 11/3001 222/190 |

FOREIGN PATENT DOCUMENTS

| | | | |
|---|---|---|---|
| JP | S63-151370 | A | 6/1988 |
| JP | H09-323746 | A | 12/1997 |
| JP | H11-588 | A | 1/1999 |
| JP | H11-513308 | A | 11/1999 |
| JP | 2007-261688 | A | 10/2007 |
| JP | 2008-531254 | A | 8/2008 |
| JP | 2009-202122 | A | 9/2009 |
| JP | 2009226384 | A | 10/2009 |
| JP | 2011-072884 | | 4/2011 |
| KR | 101125511 | B1 | 3/2012 |
| WO | 97/13585 | A1 | 4/1997 |
| WO | 2006/090229 | A1 | 8/2006 |

OTHER PUBLICATIONS

Apr. 28, 2016 Office Action issued in Chinese Patent Application No. 201380071744.6.

Dec. 5, 2016 Office Action issued in Chinese Patent Application No. 201380071744.6.

* cited by examiner

FOAM DISCHARGE DEVICE

TECHNICAL FIELD

The present invention relates to a foam discharge device.

This application claims priority based on Japanese Patent Application No. 2013-17573, filed Jan. 31, 2013, and the contents of which are incorporated herein by reference.

BACKGROUND ART

As a discharge device, a foam discharge device including a pump having a stem downwardly movably erected at a mouth section of a container main body in which a liquid is accommodated in an upwardly biased state and a pressing head disposed at an upper end section of the stem to form a nozzle hole, and a mounting cap configured to mount a pump on the mouth section of the container main body is known in the related art. In such a foam discharge device, a pump configured to form and discharge a liquid in a container main body from a nozzle hole includes a piston for a liquid linked to the stem, a cylinder for a liquid in which the piston for a liquid is vertically slidably accommodated, a piston for air linked to the stem, a cylinder for air in which the piston for air is vertically slidably accommodated, and an air-liquid mixing unit configured to mix the liquid from the cylinder for a liquid and the air from the cylinder for air to foam the liquid (for example, see Patent Document 1).

CITATION LIST

Patent Document

[Patent Document 1] Japanese Unexamined Patent Application, First Publication No. 2009-202122

SUMMARY OF INVENTION

Technical Problem

However, in the foam discharge device of the related art, for example, in order to suppress the occurrence of liquid leakage, reduce the amount of a resin to be used, reduce the necessary pressing force, or the like, when the foam discharge device is mounted on a container main body provided with a mouth section having a small diameter, in general, there is a need to reduce a size of the cylinder for air disposed in the container main body, an air volume supplied from the cylinder for air into the air-liquid mixing unit is insufficient, and discharge of a desired foam quality may be impossible.

In consideration of the above-mentioned circumstances, the present invention is directed to provide a foam discharge device capable of sufficiently securing an air volume supplied into an air-liquid mixing unit even when the foam discharge device is mounted on the container main body provided with a mouth section having a small diameter.

Solution to Problem

According to an aspect of the present invention, there is provided a foam discharge device including: a pump having a stem downwardly movably erected at a mouth section of a container main body in which a liquid is accommodated in an upwardly biased state, and a pressing head disposed at an upper end section of the stem and in which a nozzle hole is formed; and a mounting cap configured to mount the pump on the mouth section of the container main body, and configured to foam and discharge the liquid in the container main body from the nozzle hole, wherein the pump is provided with: a piston for a liquid linked to the stem; a cylinder for a liquid in which the piston for a liquid is vertically slidably accommodated; a piston for air linked to the stem; a cylinder for air in which the piston for air is vertically slidably accommodated; and an air-liquid mixing unit configured to mix a liquid from the cylinder for a liquid and air from the cylinder for air to foam the liquid, the cylinder for air is disposed inside the mounting cap and accommodated in the container main body, a head-section-side cylinder for air into which a piston tube section erected at a ceiling wall section of the mounting cap is vertically slidably fitted extends from the pressing head, and a communication path configured to bring the inside of the head-section-side cylinder for air and the inside of the cylinder for air in communication with each other is formed at the pump.

In the present invention, since the pump includes not only the cylinder for air accommodated in the container main body but also the head-section-side cylinder for air disposed outside the container main body, when the pressing head is pushed down, not only the air in the cylinder for air but also the air in the head-section-side cylinder for air can be supplied into the air-liquid mixing unit through the communication path.

Accordingly, even when the cylinder for air accommodated in the container main body has a smaller size than the present system to reduce the internal volume, a decrement of the internal volume of the cylinder for air can be supplemented by the head-section-side cylinder for air disposed outside the container main body. Accordingly, even when the foam discharge device mounted on the container main body provided with the mouth section having a small diameter, an air volume supplied into the air-liquid mixing unit can be sufficiently secured.

In addition, a through-hole through which external air is able to be supplied into the cylinder for air, the head-section-side cylinder for air and the communication path may be formed in the pump, and the through-hole may open in a standby state before the pressing head is pushed down and close as the members that constitute the pump abut each other when the pressing head is pushed down.

In this case, when the pressing head is pushed down, the through-hole closes as the members that constitute the pump abut each other, and the air in the cylinder for air and the head-section-side cylinder for air is compressed to be supplied into the air-liquid mixing unit. When the pushing down of the pressing head is released, the through-hole opens as the members that constitute the pump are returned to the position of the standby state, and the external air is supplied into the cylinder for air and the head-section-side cylinder for air.

Accordingly, even when the valve body configured to open and close the through-hole is not installed as the valve body is elastically deformed by the negative pressure generated in the cylinder for air, the head-section-side cylinder for air and the communication path, the air is supplied into the air-liquid mixing unit when the pressing head is pushed down, the external air can be supplied into the cylinder for air and the head-section-side cylinder for air upon release of the pushing down, and thus, for example, the number of parts can be reduced and the structure can be simplified.

Effects of the Invention

According to the present invention, the air volume supplied into the air-liquid mixing unit can be sufficiently secured even when the air-liquid mixing unit is mounted on the container main body provided with the mouth section having a small diameter.

DESCRIPTION OF EMBODIMENTS

Hereinafter, embodiments of the present invention will be described with reference to the accompanying drawings.

First Embodiment

Figure 1:
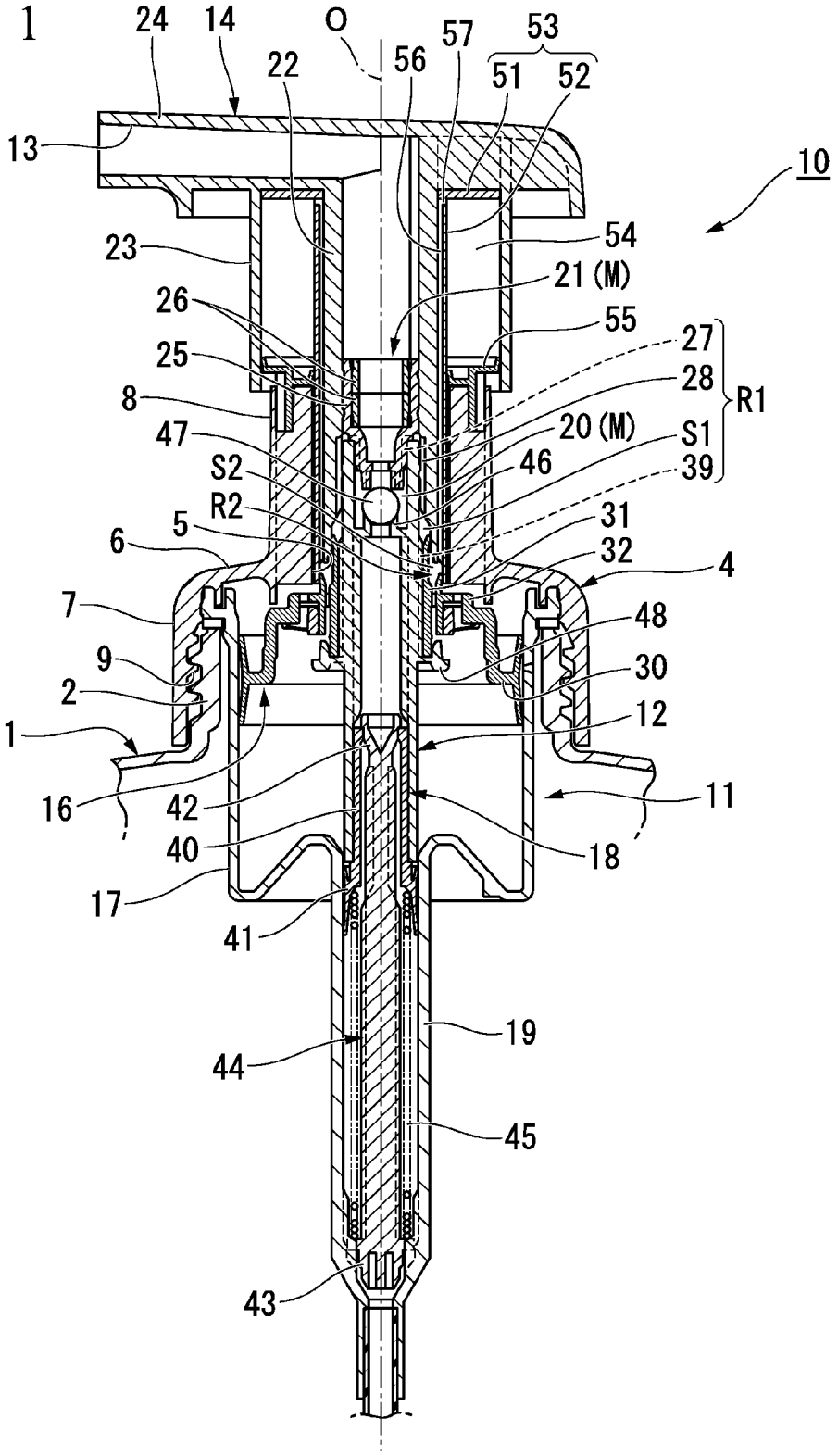
FIG. 1 is a longitudinal cross-sectional view of a foam discharge device according to a first embodiment of the present invention.

FIG. 1 shows a discharge container in which a foam discharge device 10 according to a first embodiment of the present invention is mounted on a mouth section 2 of a container main body 1. In FIG. 1, reference character O represents an axis (hereinafter referred to as a container axis O) passing a center of a lateral cross section in the container main body 1. Hereinafter, the mouth section 2 side along the container axis O is referred to as an upper side, an opposite side thereof is referred to as a lower side, and directions along the container axis O are referred to as upward and downward directions. In addition, directions perpendicular to the container axis O are referred to as radial directions, and a circumferential direction of the container axis O is referred to as a circumferential direction.

The foam discharge device 10 includes a pump 11, and the pump 11 includes a stem 12 erected on the mouth section 2 of the container main body 1 to be movable downward in an upwardly biased state and a pressing head 14 disposed at an upper end section of the stem 12 and in which a nozzle hole 13 is formed. The pump 11 is mounted on the mouth section 2 of the container main body 1 such that an axis of the stem 12 is coaxial with the container axis O. In addition, the foam discharge device 10 further includes a mounting cap 4 configured to mount the pump 11 on the mouth section 2 of the container main body 1.

In the shown example, the mounting cap 4 includes a ceiling wall section 6 in which an insertion hole 5 is formed, a mounting circumferential wall section 7 extending downward from an outer circumferential edge of the ceiling wall section 6, and a piston tube 8 extending upward from an outer circumferential edge section of the insertion hole 5 in the ceiling wall section 6, and a screw section 9 threadedly engaged with an outer circumferential surface of the mouth section 2 of the container main body 1 is formed at an inner circumferential surface of the mounting circumferential wall section 7.

The pump 11 is provided with a piston for air 16 linked to the stem 12, a cylinder for air 17 in which the piston for air 16 is vertically slidably accommodated, a piston for a liquid 18 linked to the stem 12, a cylinder for a liquid 19 in which the piston for a liquid 18 is vertically slidably accommodated, and an air-liquid mixing unit M configured to mix a liquid from the cylinder for a liquid 19 and air from the cylinder for air 17 to foam the liquid in the container main body 1. The air-liquid mixing unit M includes an air-liquid mixing chamber 20 in which the air from the cylinder for air 17 and the liquid from the cylinder for a liquid 19 are joined, and a foaming member 21 disposed between the air-liquid mixing chamber 20 and the nozzle hole 13 to foam an air-liquid mixture mixed in the air-liquid mixing chamber 20.

The cylinder for a liquid 19 and the cylinder for air 17 are each formed in a cylindrical shape, the cylinder for a liquid 19 and the cylinder for air 17 are integrally formed in this embodiment, and an outer circumferential surface of an upper end opening mouth section of the cylinder for air 17 is adhered to the mounting circumferential wall section 7 of the mounting cap 4 and the inner surface of the ceiling wall section 6. Then, as the outer circumferential surface of the upper end opening mouth section of the cylinder for air 17 is sandwiched between the inner surface of the ceiling wall section 6 and the upper end opening mouth edge of the mouth section 2, the pump 11 is fixed to the mouth section 2.

The cylinder for air 17 is formed in a bottomed cylindrical shape, and the cylinder for a liquid 19 having a cylindrical shape is connected to the bottom surface thereof such that the inside thereof is in communication with the inside of the cylinder for air 17.

That is, the cylinder for a liquid 19 having a small diameter is connected to a lower side of the cylinder for air 17 having a large diameter.

The pressing head 14 is provided with a mounting tube section 22 extending downward and into which the stem 12 is fitted, and an outer tube section 23 extending downward and configured to enclose the mounting tube section 22 from the outside in the radial direction. The upper end opening mouth section of the mounting tube section 22 is in communication with a base end opening mouth section formed in a base end of a nozzle tube section 24 having a front end in which the nozzle hole 13 is formed. The base end opening mouth section of the nozzle tube section 24 opens downward, and the mounting tube section 22 and the nozzle tube section 24 are connected to form an L shape when seen in a longitudinal cross-sectional view.

The mounting tube section 22 has a gap in the radial direction inside the piston tube 8 installed at the mounting cap 4 to be vertically movably inserted thereinto. In addition, an inner diameter of the outer tube section 23 is larger than an outer diameter of the piston tube 8, and when the pressing head 14 is pushed down, the piston tube 8 enters between the mounting tube section 22 and the outer tube section 23.

Here, in the embodiment, a cylinder division tube 53 including an annular base plate section 51 fitted onto the upper end section of the mounting tube section 22 and fitted into the upper end section of the outer tube section 23 and a passage tube section 52 extending downward from the inner circumferential edge of the annular base plate section 51 and inserted into the piston tube 8 is disposed between the mounting tube section 22 and the outer tube section 23.

The cylinder division tube 53 divides a head-section-side cylinder for air 54 into which the piston tube 8 is fitted to be vertically slidable along with the outer tube section 23. In the embodiment, a piston member 55 having an inner circumferential edge vertically slidably fitted into the passage tube section 52 and an outer circumferential edge vertically slidably fitted into an inner circumferential edge of the outer tube section 23 is installed at an upper end section of the piston tube 8, and when the pressing head 14 is moved vertically, the piston member 55 slides relatively vertically in the head-section-side cylinder for air 54.

Figure 2:
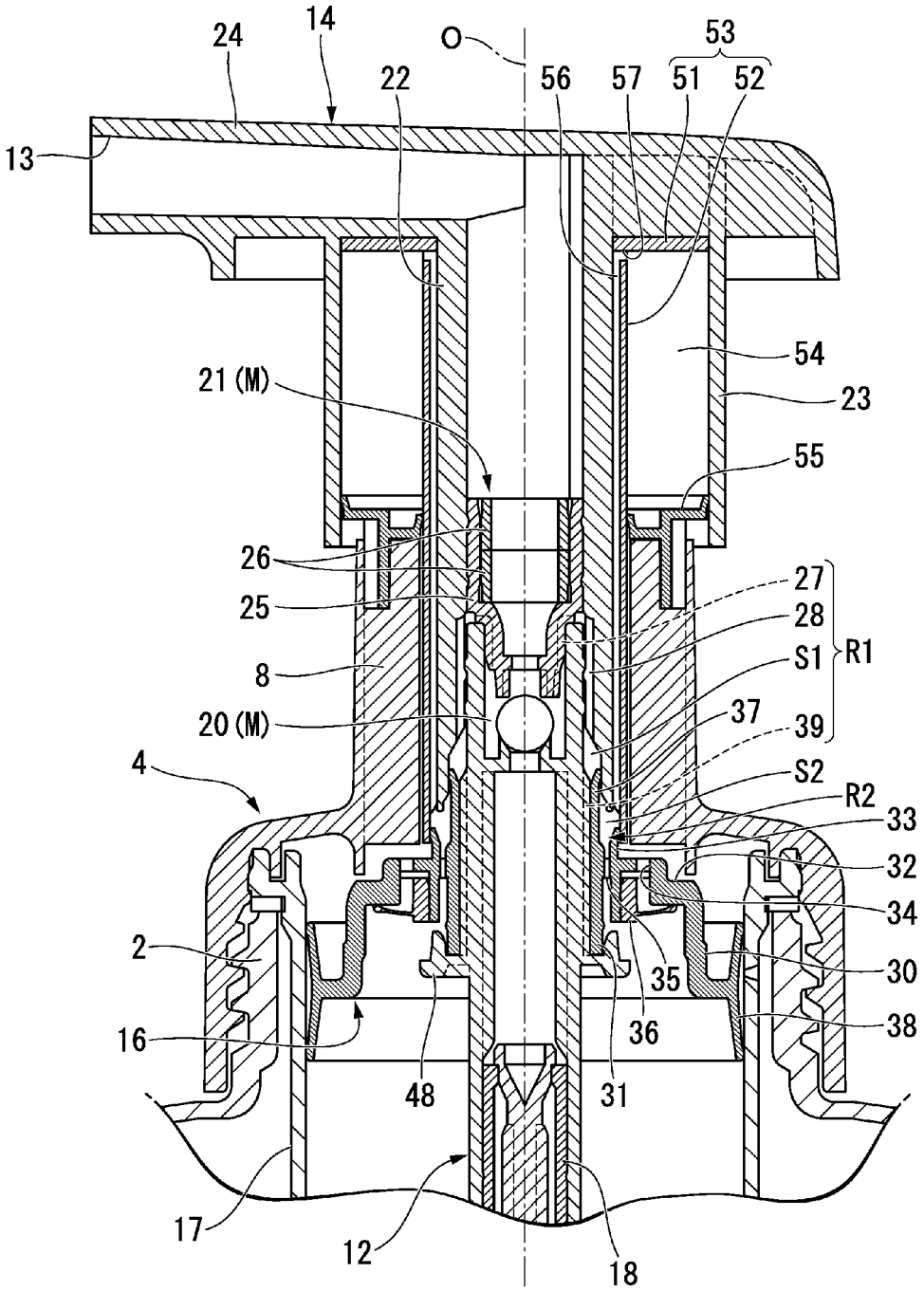
FIG. 2 is an enlarged view of FIG. 1.

As shown in FIG. 2, a lower end of the passage tube section 52 extends below the mounting tube section 22 and abuts a part of the piston for air 16. A plurality of longitudinal communication grooves 56 extending throughout the entire length in the upward and downward directions of the passage tube section 52 and opening downward are formed at the inner circumferential surface of the passage tube section 52 at intervals in the circumferential direction. In addition, a plurality of communication openings 57 passing outward separably in the radial direction from the longitudinal communication groove 56 and configured to bring the longitudinal communication groove 56 and the head-section-side cylinder for air 54 in communication with each other are formed at an upper end of the passage tube section 52.

The foaming member 21 of the air-liquid mixing unit M is disposed at a substantially central region in the upward and downward directions of the mounting tube section 22. In addition, the upper end section of the stem 12 is fitted into the lower end section of the foaming member 21.

As shown in FIGS. 1 and 2, the foaming member 21 includes a tubular casing 25, and two foaming elements 26 mounted in the casing 25. The casing 25 has a two-step cylindrical shape having a large diameter section at an upper side and a small diameter section at a lower side, the large diameter section is inserted into and fixed in the mounting tube section 22, and the small diameter section is fitted into the upper end section of the stem 12. A plurality of casing grooves 27 extending upward from the lower end to arrive at a bottom section of the outer surface of the large diameter section and extending outward and opening in the radial direction are formed at the outer circumferential surface of the small diameter section.

In addition, the foaming element 26 has a configuration in which a net is stretched at the tubular main body. The foaming element 26 disposed at a lower side of the two foaming elements 26 disposed in the casing 25 has a configuration in which the net is stretched at a lower opening surface of the tubular main body, and the foaming element 26 disposed at an upper side has a configuration in which the net is stretched at an upper opening surface of the tubular main body.

The stem 12 protrudes downward from the lower end opening mouth edge of the mounting tube section 22. A plurality of longitudinal grooves 28 extending in the upward and downward directions and opening downward are formed at a portion of the inner circumferential surface of the mounting tube section 22 to which the upper end section of the stem 12 is fitted. The longitudinal grooves 28 are formed over the upper end opening mouth edge of the stem 12 in the radial direction, and come in communication with the plurality of casing grooves 27 formed in the casing 25 of the foaming member 21.

The piston for air 16 is vertically slidably disposed in the cylinder for air 17 in a hermetically sealed state, and includes an outer tube 30 having a cylindrical multi-step shape, an inner tube 31 disposed inside the outer tube 30, and a ceiling plate section 32 configured to connect the upper end section of the outer tube 30 and the outer circumferential surface of the inner tube 31. Among these, an area of the stem 12 connected to a lower side of the upper end section fitted into the mounting tube section 22 is vertically movably inserted into the inner tube 31.

Next, as shown in FIG. 2, an annular circumferential partition wall section 33 extending upward from the upper surface of the ceiling plate section 32 and extending downward from the lower surface is integrally formed with the ceiling plate section 32, the upper end section of the circumferential partition wall section 33 is vertically movably fitted into the inner circumferential surface of the lower end section of the passage tube section 52, and the lower end section extends toward the inside of the cylinder for air 17. The air hole 34 passing in the upward and downward directions is formed in an area of the ceiling plate section 32 disposed outside in the radial direction of the circumferential partition wall section 33, and a joining hole 35 passing in the upward and downward directions is formed in an area of the ceiling plate section 32 disposed inside in the radial direction of the circumferential partition wall section 33. In addition, a valve body 36 configured to open and close an air hole 34 is fitted into the outer circumferential surface of the lower end section of the circumferential partition wall section 33.

Meanwhile, an upper sliding contact section 37 vertically slidably fitted into the inner circumferential surface of the lower end side of the mounting tube section 22 is formed at the upper edge of the inner tube 31 throughout the entire circumference of the inner tube 31. In addition, an annular lower sliding contact section 38 vertically slidably fitted into the inner surface of the cylinder for air 17 is formed at the lower end section of the outer tube 30.

Here, a gap S1 in the upward and downward directions is formed between the upper edge of the upper sliding contact section 37 and the inner surface of the mounting tube section 22. In addition, a gap is formed between the lower end of the mounting tube section 22 and the ceiling plate section 32.

The longitudinal groove 28 formed in the inner circumferential surface of the mounting tube section 22 opens in the gap S1. In addition, here, a plurality of stem grooves 39 extending in the upward and downward directions and opening in the gap S1 are formed at an area of the outer circumferential surface of the stem 12 in which the inner tube 31 is disposed in the piston for air 16. Then, the stem groove 39 opens in the gap S1. Here, an air passage R1 configured to bring the cylinder for air 17 and the air-liquid mixing chamber 20 in communication with each other is constituted by the stem groove 39, the longitudinal groove 28 formed in the mounting tube section 22, the casing groove 27 formed in the casing 25 of the foaming member 21, and the gap S1.

In addition, a gap S2 in the upward and downward directions is formed between the inner tube 31 and the circumferential partition wall section 33 of the piston for air 16 and between the ceiling plate section 32 and the lower end of the mounting tube section 22. In the gap S2, the lower end of the longitudinal communication groove 56 formed in the cylinder division tube 53 opens, and the joining hole 35 formed in the ceiling plate section 32 opens. Here, a communication path R2 configured to bring the inside of the head-section-side cylinder for air 54 and the inside of the cylinder for air 17 in communication is constituted by the longitudinal communication groove 56, the communication opening 57 in communication with the upper end of the longitudinal communication groove 56, the joining hole 35, and the gap S2.

Meanwhile, as shown in FIG. 1, in the piston for a liquid 18 vertically slidably disposed in the cylinder for a liquid 19, the upper end side becomes a small diameter tube section 40 inserted and fixed into the stem 12 in a liquid-tight state, and the lower end side becomes a large diameter tube section 41 that protrudes downward from the lower end opening mouth edge of the stem 12 and an outer circumferential surface of which is substantially flush with the outer circumferential surface of the stem 12.

A rod-shaped valve member 44 having an upper end section that becomes an upper valve body 42 formed in a hollow reverse conical shape and a lower end section that becomes a lower valve body 43 that is able to sit on or separate from the lower end opening mouth section in the cylinder for a liquid 19 is installed in the piston for a liquid 18 and the cylinder for a liquid 19.

The upper valve body 42 is a valve configured to switch communication and blocking thereof between the inside of the cylinder for a liquid 19 and the inside of the upper end section of the stem 12. Here, reference numeral 45 of the drawings designates a coil spring disposed between the piston for a liquid 18 and the lower end section inner surface of the cylinder for a liquid 19, and the coil spring 45 supports the piston for a liquid 18 from a lower side of the large diameter tube section 41 to be downwardly movable in the upwardly biased state.

Here, in the inner circumferential surface of the stem 12, an annular valve seat 46 directed inward in the radial direction protrudes from a portion thereof between the piston for a liquid 18 and the foaming member 21, and a spherical liquid discharge valve 47 that is able to sit on or separate from the valve seat 46 is installed. Then, in the stem 12, a space between the lower end of the small diameter section of the foaming member 21 and the upper surface of the valve seat 46 becomes the air-liquid mixing chamber 20.

In addition, a flange section 48 overhanging outward in the radial direction and abutting the lower end of the inner tube 31 of the piston for air 16 from below the inner tube 31 is formed at a portion of the outer circumferential surface of the stem 12 in which the lower ends of the plurality of stem grooves 39 are disposed. The flange section 48 is integrally formed with the stem 12, and in a standby state before the pressing head 14 is pressed downward, the lower end of the inner tube 31 of the piston for air 16 abuts the flange section 48.

As shown in FIGS. 1 and 2, in the above-mentioned foam discharge device 10, in the standby state before the pressing head 14 is pressed downward, the lower end of the inner tube 31 of the piston for air 16 abuts the flange section 48 of the stem 12, the gap S1 in the upward and downward directions is formed between the inner surface of the mounting tube section 22 of the pressing head 14 and the upper edge of the upper sliding contact section 37 of the inner tube 31, and the gap S2 is formed between the lower end of the mounting tube section 22 and the ceiling plate section 32.

From this state, when the pressing head 14 is pushed down, the mounting tube section 22 is lowered, and the foaming member 21, the stem 12 and the piston for a liquid 18 are also moved downward while the coil spring 45 is compressively deformed in the upward and downward directions. Here, since the inner tube 31 of the piston for air 16 is vertically movably inserted through a portion of the stem 12 connected to the lower side of the upper end section fitted into the mounting tube section 22, the piston for air 16 does not move during the pushing down of the pressing head 14 to a predetermined moving distance in an initial step, and a gap is formed between the lower end of the inner tube 31 of the piston for air 16 and the flange section 48 of the stem 12. In addition, the gap S1 between the upper edge of the inner tube 31 of the piston for air 16 and the inner surface of the mounting tube section 22 is reduced, and the gap S2 between the lower end of the mounting tube section 22 and the ceiling plate section 32 is reduced.

Accordingly, the inside of the cylinder for air 17 and the inside of the air-liquid mixing chamber 20 are in communication with each other through the air passage R1, and the inside of the head-section-side cylinder for air 54 is in communication with the inside of the air-liquid mixing chamber 20 through the communication path R2, the cylinder for air 17 and the air passage R1.

Further, according to downward movement of the piston for a liquid 18, the lower valve body 43 is also moved downward, the lower valve body 43 is set to close the lower end opening mouth section of the cylinder for a liquid 19, the upper end section of the piston for a liquid 18 is separated downward from the upper valve body 42 of the valve member 44, and the cylinder for a liquid 19 is in communication with the inside of the stem 12.

Then, when the pressing head 14 is further pushed down, the gap S1 is further reduced, the upper edge of the inner tube 31 approaches or abuts the inner surface of the mounting tube section 22, the piston for air 16 is also moved downward in a state in which the valve body 36 closes the air hole 34, and thus the air in the lower chamber disposed under the piston for air 16 is compressed in the cylinder for air 17.

Figure 3:
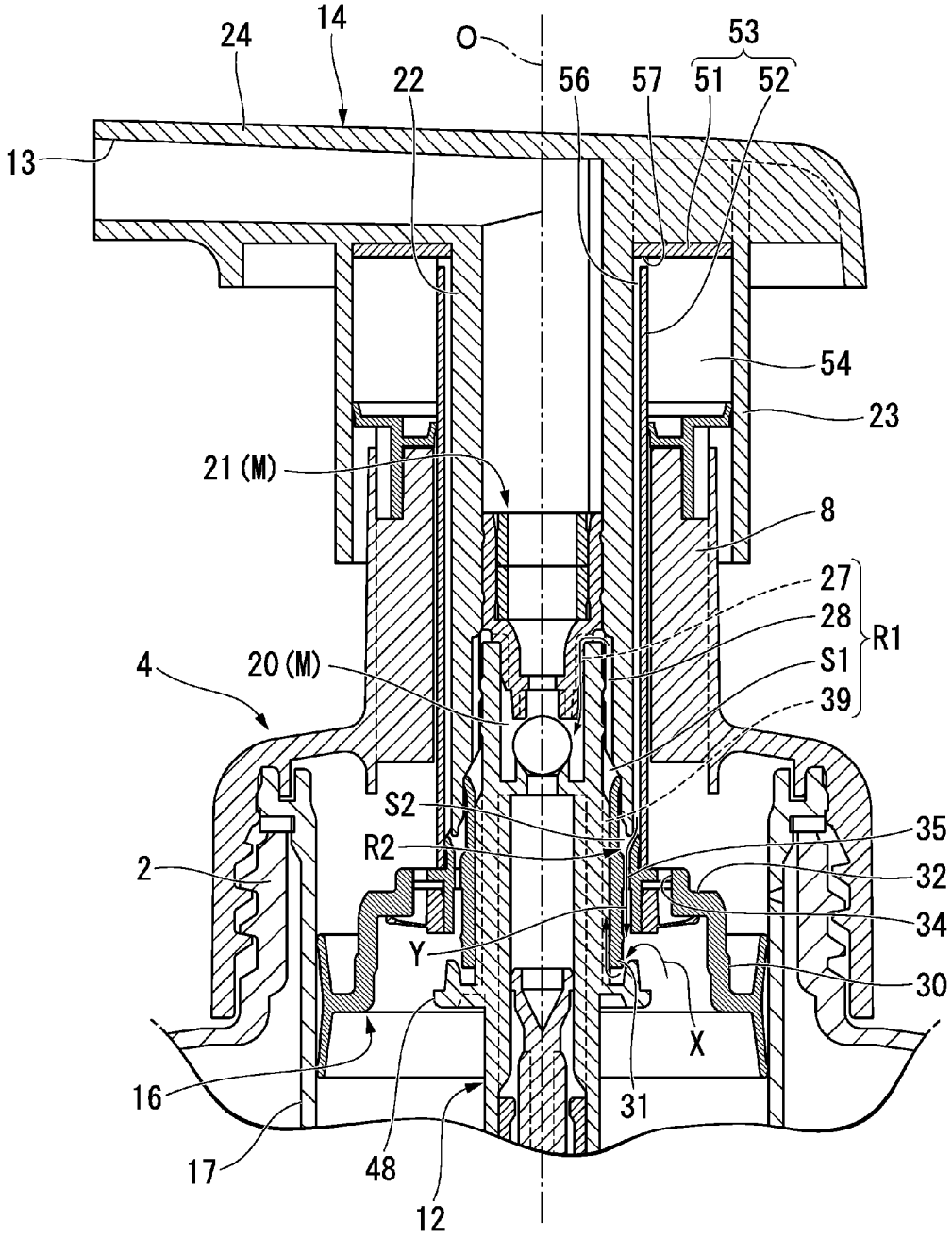
FIG. 3 is a view for describing an action of the foam discharge device according to the first embodiment of the present invention.

Accordingly, as shown by an arrow X of FIG. 3, the air in the lower chamber of the cylinder for air 17 flows into the air passage R1 from the gap between the lower end of the inner tube 31 of the piston for air 16 and the flange section 48 of the stem 12 to be conveyed into the air-liquid mixing chamber 20.

In addition, with this, the piston tube 8 of the mounting cap 4 enters relatively upward in the head-section-side cylinder for air 54 of the pressing head 14, the piston member 55 of the upper end section slides in the head-section-side cylinder for air 54, and the air in the upper chamber disposed above the piston member 55 is compressed in the head-section-side cylinder for air 54. Further, in this case, communication between the longitudinal communication groove 56 and the joining hole 35 through the gap S2 is maintained while the lower end of the mounting tube section 22 approaches the ceiling plate section 32.

Accordingly, as shown by an arrow Y of FIG. 3, the air in the upper chamber of the head-section-side cylinder for air 54 flows into the air passage R1 from the gap between the lower end of the inner tube 31 of the piston for air 16 and the flange section 48 of the stem 12 through the communication path R2 and the cylinder for air 17 to be conveyed into the air-liquid mixing chamber 20.

Further, here, since the piston for a liquid 18 is moved downward in a state in which the lower valve body 43 of the valve member 44 closes the lower end opening mouth section of the cylinder for a liquid 19, the liquid in the cylinder for a liquid 19 is raised to arrive at the inside of the stem 12. Then, the liquid pressure in the cylinder for a liquid 19 is applied to the liquid discharge valve 47 sitting on the valve seat 46 of the stem 12 to separate the liquid discharge valve 47 from the valve seat 46, and thus the liquid in the cylinder for a liquid 19 is conveyed into the air-liquid mixing chamber 20.

As described above, the liquid and the air are joined in the air-liquid mixing chamber 20 and the liquid passes through the foaming member 21 to be foamed, and then a foam-shaped liquid (an air-liquid mixture (a foam body)) is discharged through the nozzle hole 13 of the pressing head 14.

Then, when the pushing down of the pressing head 14 is released, the pressing head 14, the stem 12, the piston for air 16 linked to the stem 12, and the piston for a liquid 18 are returned to the upwardly biased state by the elastic recovery force of the coil spring 45. Specifically, as the stem 12 is raised, the lower end section of the inner tube 31 of the piston for air 16 abuts (sits on) the flange section 48, and the piston for air 16 is raised together with the stem 12.

In the foam discharge device 10 of the embodiment of the present invention as described above, since the pump 11 includes not only the cylinder for air 17 accommodated in the container main body 1 but also the head-section-side cylinder for air 54 disposed outside the container main body 1, when the pressing head 14 is pushed down, not only the air in the cylinder for air 17 but also the air in the head-section-side cylinder for air 54 are supplied into the air-liquid mixing chamber 20 through the communication path R2.

Accordingly, even when the cylinder for air 17 accommodated in the container main body 1 has a smaller size than the present system to reduce the internal volume, a decrement of the internal volume of the cylinder for air 17 can be supplemented by the head-section-side cylinder for air 54 disposed outside the container main body 1.

Accordingly, even when the foam discharge device is mounted on the container main body 1 provided with the mouth section 2 having a small diameter, the air volume supplied into the air-liquid mixing unit M can be sufficiently secured.

Second Embodiment

Next, a second embodiment of the present invention will be described with reference to FIGS. 4 and 5. Further, in the second embodiment, the same components as the first embodiment are designated by the same reference numerals, and description thereof will be omitted.

Figure 5:
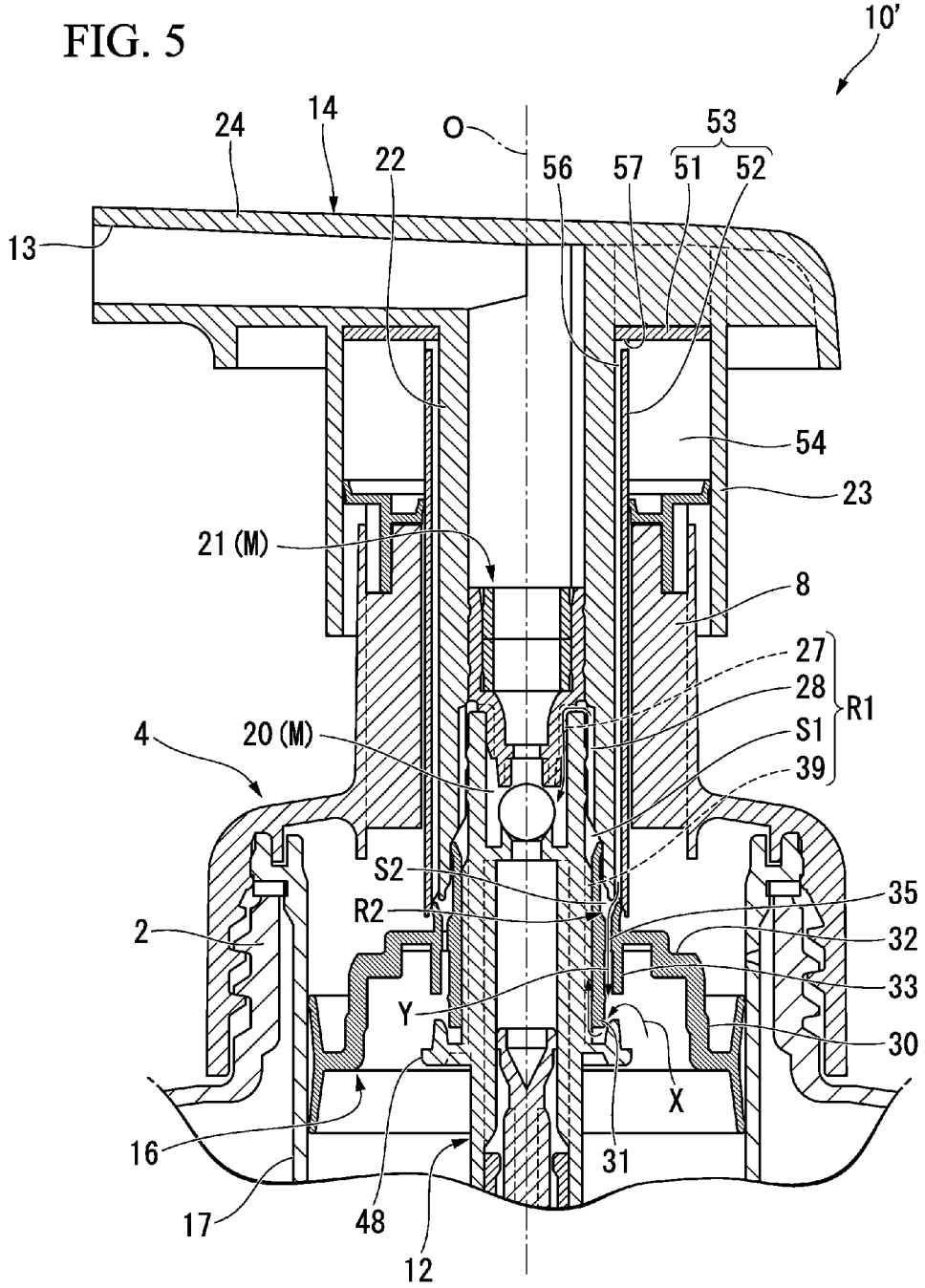
FIG. 5 is a longitudinal cross-sectional view of the foam discharge device according to the second embodiment of the present invention, showing a longitudinal cross-sectional view of a state in which a pressing head is pushed down.

As shown in FIG. 5, in a foam discharge device 10' of the embodiment, in the piston for air 16, the air hole 34 described in the first embodiment is not formed in the ceiling plate section 32, and the valve body 36 is not installed either. Meanwhile, in the standby state before the pressing head 14 is pushed down, a through-hole 58 in communication with the outside is formed between the passage tube section 52 and the piston for air 16. Specifically, in the standby state, the through-hole 58 is formed as the upper end section of the circumferential partition wall section 33 is spaced apart from the inner circumferential surface of the lower end section of the passage tube section 52, the gap S2 is directed outward in the radial direction to come in communication with the space between the piston for air 16 and the mounting cap 4. In other words, the communication path R2 constituted by the longitudinal communication groove 56, the communication opening 57 continuing to the upper end of the longitudinal communication groove 56, the joining hole 35 and the gap S2 branches off to the joining hole 35 and the inside of the space between the piston for air 16 and the mounting cap 4 at a position of the gap S2.

Then, in the embodiment, when the pressing head 14 is pushed down to a predetermined amount, the upper end section of the circumferential partition wall section 33 is fitted into the inner circumferential surface of the lower end section of the passage tube section 52 to close the through-hole 58, and communication of the gap S2 with the inside of the space between the piston for air 16 and the mounting cap 4 is blocked. In this state, the communication path R2 does not branch into the space between the piston for air 16 and the mounting cap 4 at the position of the gap S2, and brings the head-section-side cylinder for air 54 and the cylinder for air 17 in communication with each other with air tightness. Further, when the pressing head 14 is pushed down, since the upper end section of the circumferential partition wall section 33 is easily inserted into the inner circumferential surface of the lower end section of the passage tube section 52, a thickness in the radial direction is formed in an inclined shape to be gradually reduced from the inside to the outside in the radial direction as it goes downward.

Figure 4:
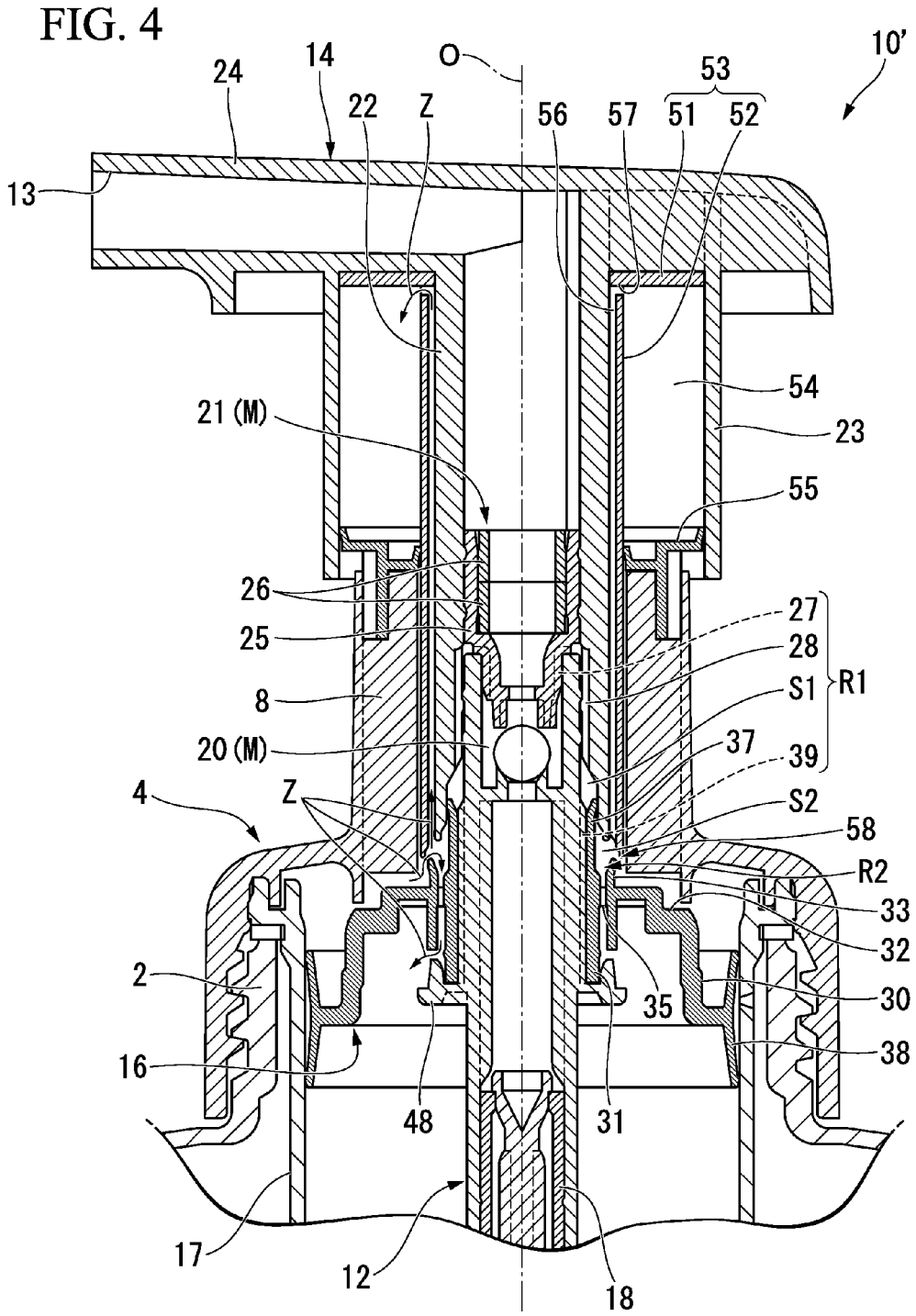
FIG. 4 is a longitudinal cross-sectional view of a foam discharge device according to a second embodiment of the present invention.

In the foam discharge device 10' of the above-mentioned embodiment, as shown in FIG. 4, in the standby state before the pressing head 14 is pushed down, the lower end of the inner tube 31 of the piston for air 16 abuts the flange section 48 of the stem 12, the gap S1 in the upward and downward directions is formed between the inner surface of the mounting tube section 22 of the pressing head 14 and the upper edge of the upper sliding contact section 37 of the inner tube 31, the gap S2 is formed between the lower end of the mounting tube section 22 and the ceiling plate section 32, and the gap S2 is directed outward in the radial direction through the through-hole 58 to come in communication with the space between the piston for air 16 and the mounting cap 4.

From this state, when the pressing head 14 is pushed down, the mounting tube section 22 is lowered, and the foaming member 21, the stem 12 and the piston for a liquid 18 are also moved downward while the coil spring 45 (see FIG. 1) is compressively deformed in the upward and downward directions. Here, since the inner tube 31 of the piston for air 16 is vertically movably inserted into a portion of the stem 12 continuing to the lower side of the upper end section fitted into the mounting tube section 22, the piston for air 16 does not move during the pushing down of the pressing head 14 to the predetermined moving distance in the initial step, a gap is formed between the lower end of the inner tube 31 of the piston for air 16 and the flange section 48 of the stem 12.

In addition, the gap S1 between the upper edge of the inner tube 31 of the piston for air 16 and the inner surface of the mounting tube section 22 is reduced, and the gap S2 between the lower end of the mounting tube section 22 and the ceiling plate section 32 is reduced. Then, in the process of pushing the pressing head 14 down, the upper end section of the circumferential partition wall section 33 is fitted into the inner circumferential surface of the lower end section of the passage tube section 52 to close the through-hole 58, and communication of the gap S2 with the space between the piston for air 16 and the mounting cap 4 is blocked. That is, the communication path R2 does not branch into the space between the piston for air 16 and the mounting cap 4 at the position of the gap S2, and the head-section-side cylinder for air 54 and the cylinder for air 17 come in communication with each other with air tightness.

Accordingly, the inside of the cylinder for air 17 is in communication with the inside of the air-liquid mixing chamber 20 through the air passage R1, and the inside of the head-section-side cylinder for air 54 is in communication with the inside of the air-liquid mixing chamber 20 through the communication path R2, the cylinder for air 17 and the air passage R1.

Then, when the pressing head 14 is further pushed down, the gap S1 is further reduced, the upper edge of the inner tube 31 and the inner surface of the mounting tube section 22 approach or abut each other, the piston for air 16 is also moved downward in a state in which the through-hole 58 is closed, and thus the air in the lower chamber disposed under the piston for air 16 is compressed in the cylinder for air 17.

Accordingly, as shown by the arrow X of FIG. 5, the air in the lower chamber of the cylinder for air 17 flows into the air passage R1 from the gap between the lower end of the inner tube 31 of the piston for air 16 and the flange section 48 of the stem 12 to be conveyed into the air-liquid mixing chamber 20. Further, in FIG. 5, the upper end section of the circumferential partition wall section 33 is fitted into the inner circumferential surface of the lower end section of the passage tube section 52, and communication of the gap S2 with the space between the piston for air 16 and the mounting cap 4 is blocked.

In addition, with this, the piston tube 8 of the mounting cap 4 enters the head-section-side cylinder for air 54 of the pressing head 14 in a relatively upward direction, the piston member 55 of the upper end section slides in the head-section-side cylinder for air 54, and the air in the upper chamber disposed over the piston member 55 is compressed in the head-section-side cylinder for air 54. In this case, communication between the longitudinal communication groove 56 and the joining hole 35 through the gap S2 is maintained while the lower end of the mounting tube section 22 and the ceiling plate section 32 approach each other.

Accordingly, as shown by the arrow Y of FIG. 5, the air in the upper chamber in the head-section-side cylinder for air 54 flows into the air passage R1 from the gap between the lower end of the inner tube 31 of the piston for air 16 and the flange section 48 of the stem 12 through the communication path R2 and the cylinder for air 17 to be conveyed into the air-liquid mixing chamber 20.

Meanwhile, when the pushing down of the pressing head 14 is released, the pressing head 14, the stem 12, the piston for air 16 linked to the stem 12 and the piston for a liquid 18 are returned to the upwardly biased state by the elastic recovery force of the coil spring 45. Specifically, as the stem 12 is raised, the lower end section of the inner tube 31 of the piston for air 16 abuts (sits on) the flange section 48, and the piston for air 16 is raised together with the stem 12.

Then, in this case, as shown in FIG. 4, the gap S1 and the gap S2 are increased, and the gap S2 is directed outward in the radial direction through the through-hole 58 to come in communication with the space between the piston for air 16 and the mounting cap 4. In addition, the inside of the lower chamber disposed under the piston for air 16 in the cylinder for air 17 is expanded to have a negative pressure.

Accordingly, as shown by an arrow Z of FIG. 4, external air flows into the cylinder for air 17 from the through-hole 58 between the upper end section of the circumferential partition wall section 33 and the inner circumferential surface of the lower end section of the passage tube section 52 through the gap S2 and the joining hole 35, and external air flows into the head-section-side cylinder for air 54 from the through-hole 58 through the gap S2, the longitudinal communication groove 56 and the communication opening 57.

In the foam discharge device 10' of the above-mentioned second embodiment, when the pushing down of the pressing head 14 is released without using the air hole 34 or the valve body 36 as described in the first embodiment, since the external air can flow into the cylinder for air 17 and the head-section-side cylinder for air 54, the structure can be simplified and reduced in size.

Further, in the above-mentioned embodiment, although the upper end section of the circumferential partition wall section 33 is fitted into the inner circumferential surface of the lower end section of the passage tube section 52 to close the through-hole 58, and timing of blocking the communication of the gap S2 with the space between the piston for air 16 and the mounting cap 4 is before the piston for air 16 is pushed down together with the pushing down of the pressing head 14, the timing may be after the pushing down.

Third Embodiment

Next, a third embodiment of the present invention will be described with reference to FIGS. 6 and 7. While a foam discharge device 10" of the third embodiment has the same basic configuration as the foam discharge device 10' of the second embodiment, a shape of the lower end section of the passage tube section 52 is different from the foam discharge device 10' of the second embodiment. In the third embodiment, the same components as the second embodiment are designated by the same reference numerals, and description thereof will be omitted.

Figure 6:
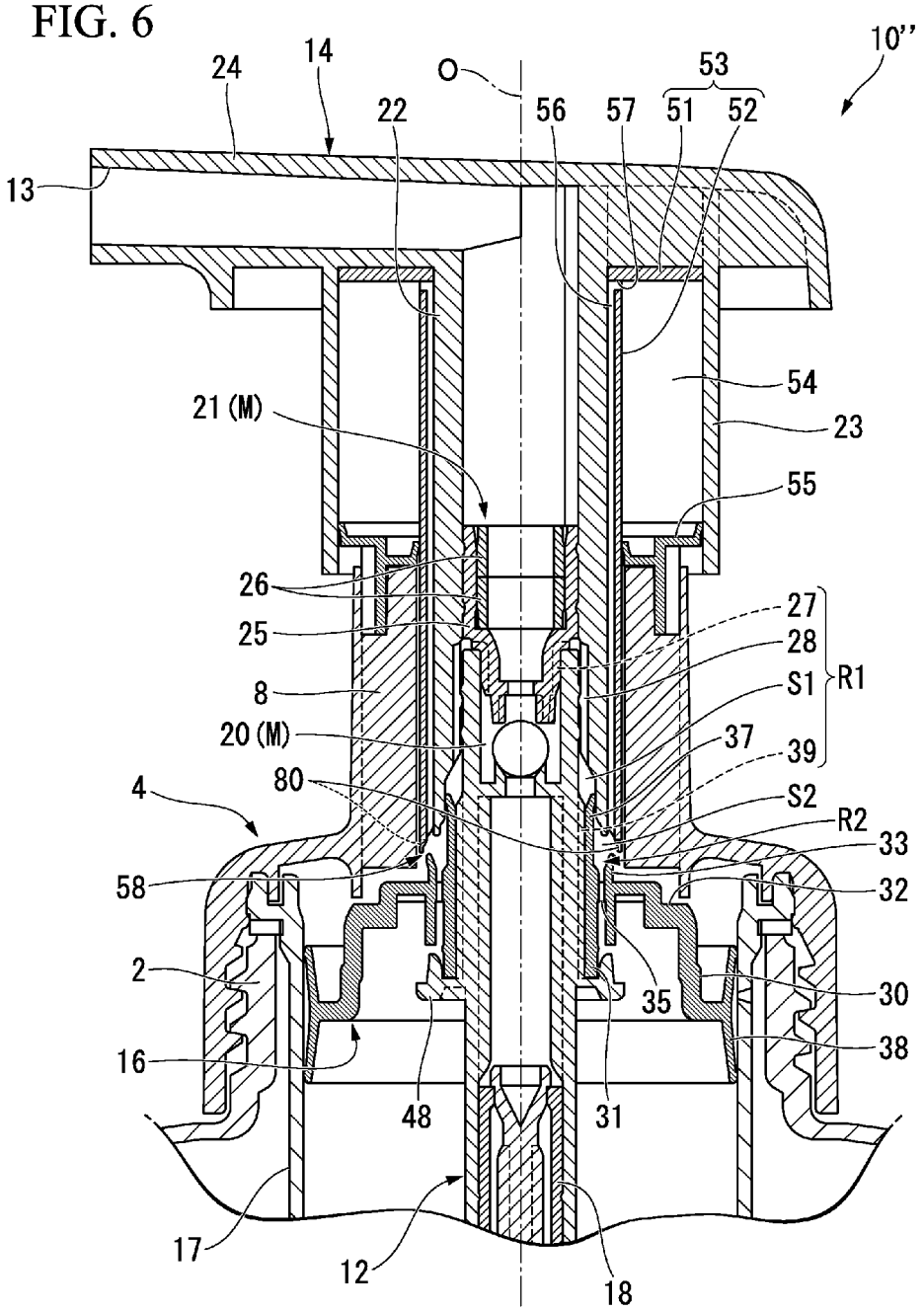
FIG. 6 is a longitudinal cross-sectional view of a foam discharge device according to a third embodiment of the present invention.

As shown in FIG. 6, in the foam discharge device 10" of the embodiment, a plurality of slits 80 extending upward from the lower end and passing in the radial direction are formed at the passage tube section 52 throughout the circumferential direction.

Figure 7:
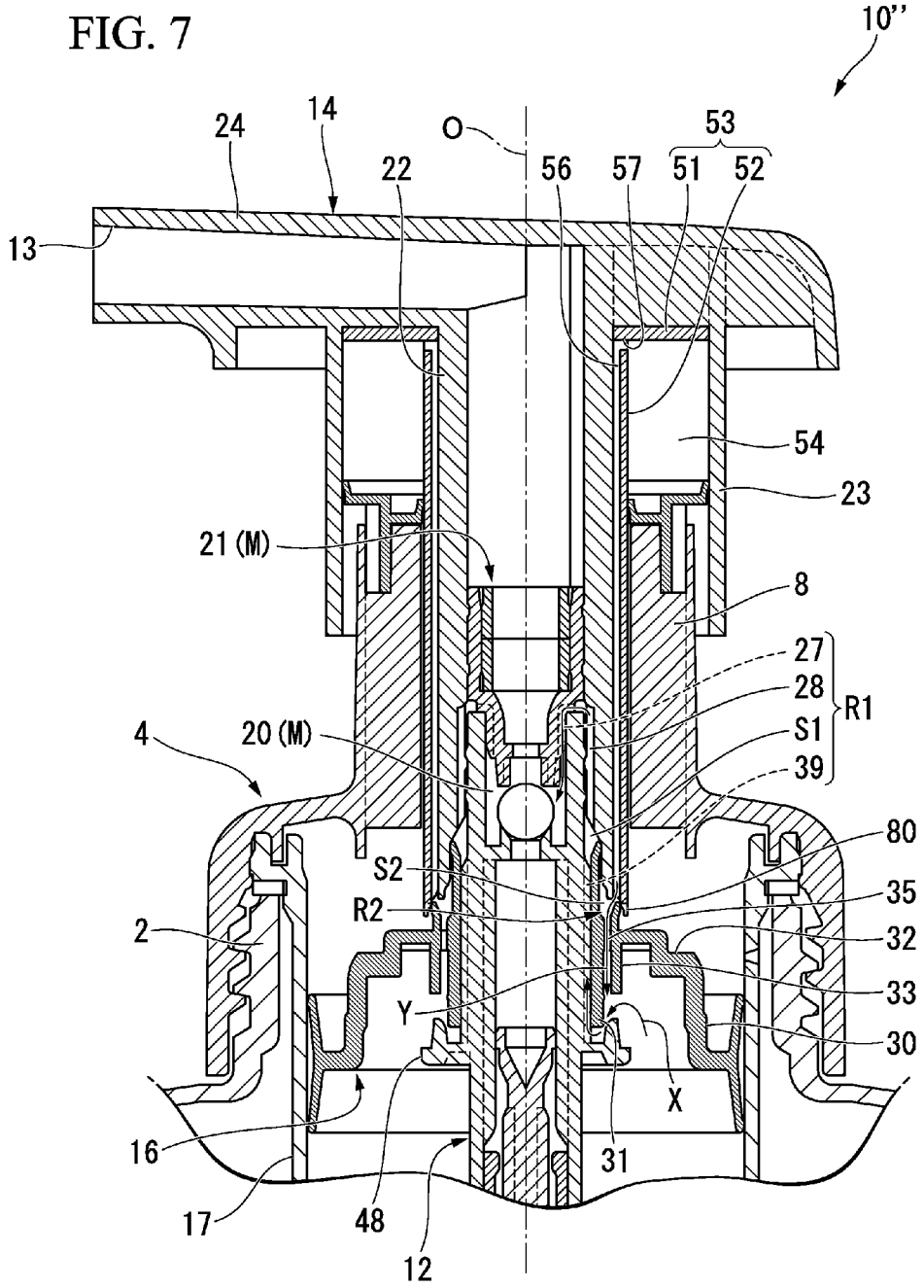
FIG. 7 is a longitudinal cross-sectional view of the foam discharge device according to the third embodiment of the present invention, showing a longitudinal cross-sectional view of a state in which a pressing head is pushed down.

In the slit 80, before the piston for air 16 is pushed down while the pressing head 14 is pushed down, the upper end section of the circumferential partition wall section 33 is fitted into the inner circumferential surface of the lower end section of the passage tube section 52 to close the through-hole 58, and, as shown in FIG. 7, the upper end of the slit 80 is disposed under the upper end section of the circumferential partition wall section 33 before the piston for air 16 is pushed down while the pressing head 14 is pushed down such that communication of the gap S2 with the space between the piston for air 16 and the mounting cap 4 is blocked.

In the foam discharge device 10" of the above-mentioned third embodiment, when the pushing down of the pressing head 14 is released and the external air flows into the cylinder for air 17, the external air can efficiently flow into the cylinder for air 17 and the head-section-side cylinder for air 54 through the slit 80.

Fourth Embodiment

Next, a fourth embodiment of the present invention will be described with reference to FIGS. 8 and 9. Further, in the fourth embodiment, the same components as the first embodiment are designated by the same reference numerals, and description thereof will be omitted.

Figure 8:
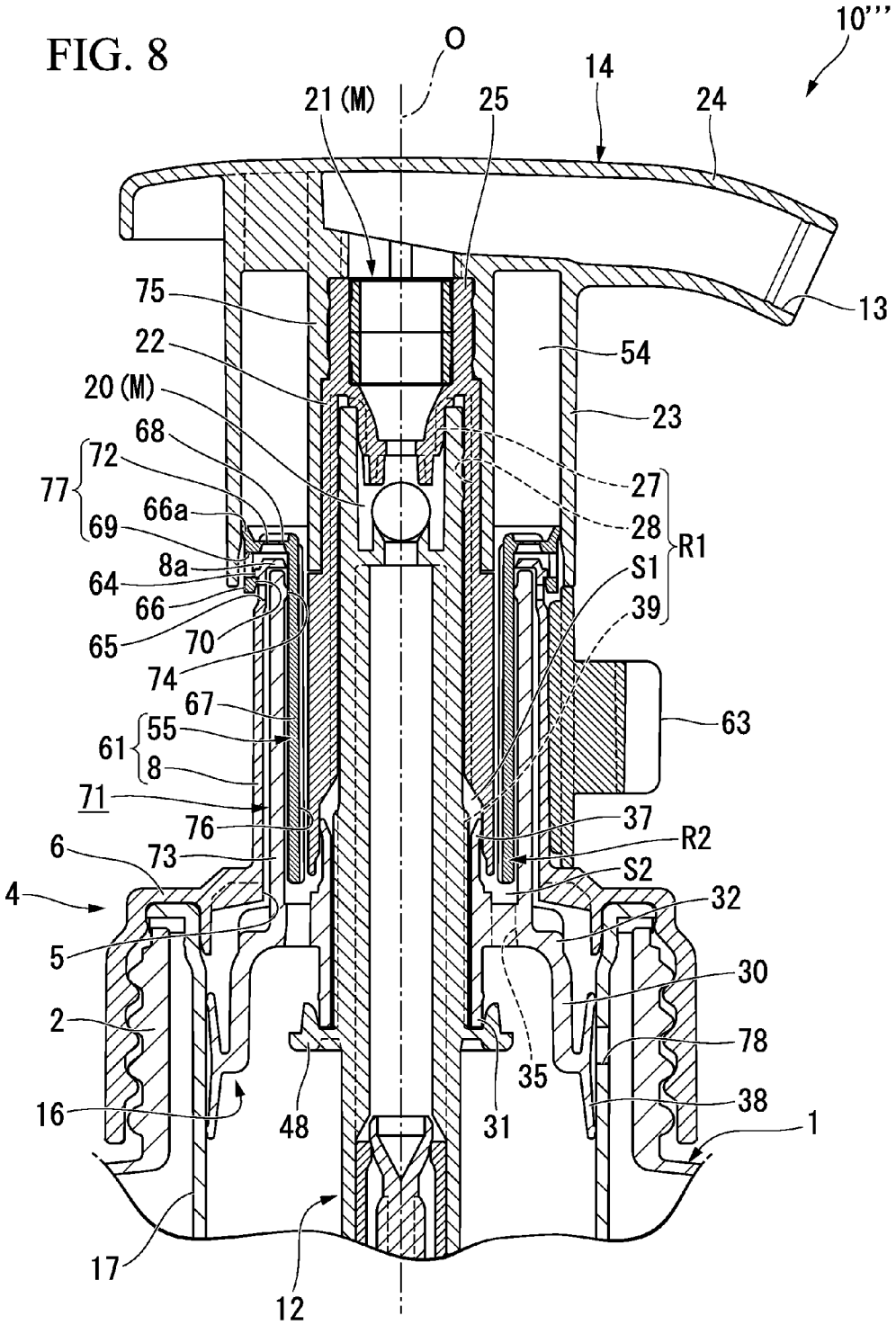
FIG. 8 is a longitudinal cross-sectional view of a foam discharge device according to a fourth embodiment of the present invention.

As shown in FIG. 8, in the foam discharge device 10''' of the embodiment, in the piston for air 16, the circumferential partition wall section 33 and the air hole 34 described in the first to third embodiments are not formed in the ceiling plate section 32. In addition, the valve body 36 and the cylinder division tube 53 are not installed.

The foam discharge device 10''' has a piston tube section 61 disposed at the ceiling wall section 6 of the mounting cap 4. The piston tube section 61 includes the piston tube 8 and the piston member 55.

The piston tube 8 is erected at the inner circumferential edge section of the ceiling wall section 6 of the mounting cap 4. A restriction member 63 configured to restrict the pushing down of the pressing head 14 is separably mounted on the piston tube 8. An annular support surface section 8*a* protruding inward in the radial direction is formed at the upper end section of the piston tube 8. The upper surface of the support surface section 8*a* constitutes the upper end surface of the piston tube 8.

A first engagement protrusion 64 and a first through-hole 65 are formed at the piston tube 8. The first engagement protrusion 64 protrudes from the piston tube 8 outward in the radial direction. The first engagement protrusion 64 is disposed at a portion of the piston tube 8 disposed below the support surface section 8*a*.

The first through-hole 65 passes through the piston tube 8 in the radial direction. The first through-hole 65 is disposed at a portion of the piston tube 8 disposed below the first engagement protrusion 64.

The piston member 55 is disposed to be capable of approaching or separating from the upper end surface of the piston tube 8 from above. The piston member 55 includes an outer sliding tube 66, an inner sliding tube 67 and a connecting section 68. The outer sliding tube 66 is installed outside the piston tube 8, and the inner sliding tube 67 is installed inside the piston tube 8. The connecting section 68 connects the outer sliding tube 66 and the inner sliding tube 67.

The outer sliding tube 66 is vertically slidably fitted onto the upper end section of the piston tube 8. The upper end section of the outer sliding tube 66 protruding upward from the support surface section 8*a* is a tapered section 66*a* having a diameter that increases as it goes upward.

In the outer sliding tube 66, a second through-hole 69 and a second engagement protrusion 70 are formed. The second through-hole 69 passes through the outer sliding tube 66 in the radial direction. The second through-hole 69 is disposed at a portion of the outer sliding tube 66 below the tapered section 66*a*. The second engagement protrusion 70 protrudes from the outer sliding tube 66 inward in the radial direction. The second engagement protrusion 70 is disposed at a portion of the outer sliding tube 66 below the second through-hole 69. The second engagement protrusion 70 is engaged with the first engagement protrusion 64 from below the first engagement protrusion 64.

The lower end section of the inner sliding tube 67 is disposed below the lower end section of the outer sliding tube 66 and disposed in the insertion hole 5. The inner sliding tube 67 defines an annular space 71 between the inner sliding tube 67 and the piston tube 8.

The connecting section 68 is formed in an annular plate shape, front and back surfaces of which are directed in the upward and downward directions, and connects the upper end sections of the outer sliding tube 66 and the inner sliding tube 67. The connecting section 68 is opposite to the upper end surface of the piston tube 8 in the upward and downward directions, and abuts and separates from the upper end surface from above. A through-hole 72 passing through the connecting section 68 in the upward and downward directions is formed in the connecting section 68.

In addition, in the embodiment, a guide tube section 73 inserted into the annular space 71 is erected at the piston for air 16. A seal protrusion section 74 is installed at the inner circumferential surface of the guide tube section 73. The seal protrusion section 74 is formed in an annular shape continuously extending throughout the circumferential direction. The seal protrusion section 74 is vertically slidably fitted into the inner sliding tube 67, and air-tightly abuts the outer circumferential surface of the inner sliding tube 67. Further, the joining hole 35 opens in the guide tube section 73.

Further, in the embodiment, the mounting tube section 22 is formed to be separable from the pressing head 14, and a fitting tube section 75 is integrally formed with the pressing head 14. The fitting tube section 75 extends downward from the base end opening mouth section of the nozzle tube section 24. The casing 25 is fitted into the upper section of the fitting tube section 75, and the casing 25 is disposed immediately under the base end opening mouth section of the nozzle tube section 24.

The mounting tube section 22 is fitted into the lower section of the fitting tube section 75, and comes in communication with the base end opening mouth section of the nozzle tube section 24 through the casing 25. The mounting tube section 22 is integrally formed with the casing 25, and the upper end section of the mounting tube section 22 is connected to a connecting portion of the casing 25 between the large diameter section and the small diameter section. The mounting tube section 22 protrudes downward from the fitting tube section 75, and a communication gap 76 opening in the upward and downward directions is formed between the fitting tube section 75 and the inner sliding tube 67 and between the portion of the mounting tube section 22 protruding downward from the fitting tube section 75 and the inner sliding tube 67.

In the above-mentioned foam discharge device 10''', the head-section-side cylinder for air 54 is defined in an annular shape between the outer tube section 23 and the fitting tube section 75. In addition, the gap S2 is disposed between the inner tube 31 and the guide tube section 73 in the piston for air 16, and defined between the ceiling plate section 32, the lower end of the mounting tube section 22 and the lower end of the inner sliding tube 67. Then, the communication path R2 is constituted by the communication gap 76, the gap S2 and the joining hole 35.

The piston tube section 61 is vertically slidably fitted into the head-section-side cylinder for air 54, and in the embodiment, in the piston tube section 61, the tapered section 66*a* of the piston member 55 is vertically slidably fitted into the outer tube section 23. The tapered section 66*a* air-tightly abuts the inner circumferential surface of the outer tube section 23. In the above-mentioned foam discharge device 10''', the through-hole 72 formed in the connecting section 68 is formed in a member configured to define the cylinder for air 17, the head-section-side cylinder for air 54 and the communication path R2.

In the above-mentioned foam discharge device 10''', as shown in FIG. 8, in the standby state before the pressing head 14 is pushed down, the first engagement protrusion 64 and the second engagement protrusion 70 are engaged with each other, and the connecting section 68 is separated upward from the upper end surface of the piston tube 8 to open the through-hole 72. The through-hole 72 is in communication with the first through-hole 65 between the connecting section 68 and the piston tube 8, and the through-hole 72 and the first through-hole 65 constitute an introduction path 77 configured to bring the inside of the head-section-side cylinder for air 54 and the outside in communication with each other.

Figure 9:
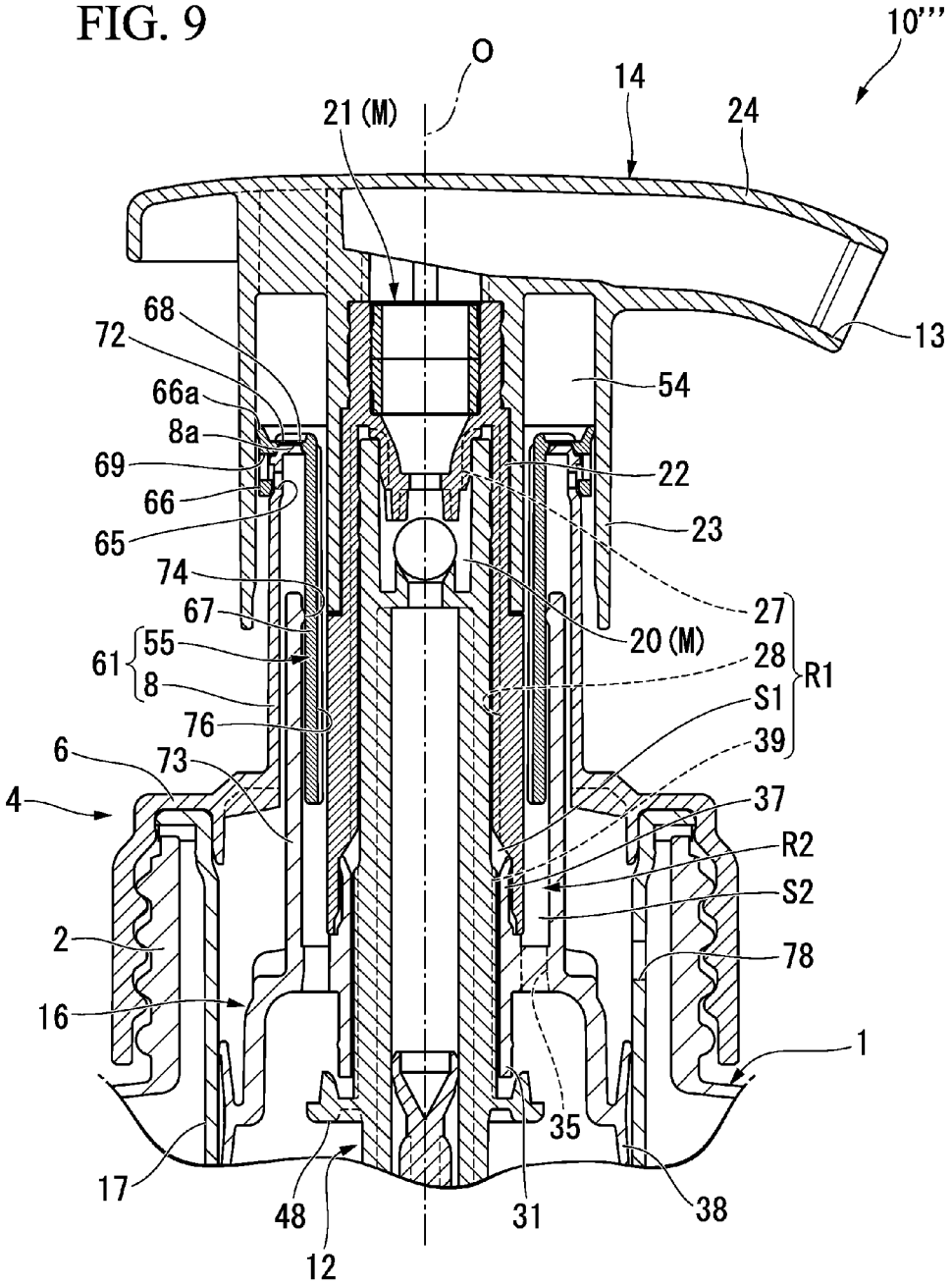
FIG. 9 is a longitudinal cross-sectional view of the foam discharge device according to the fourth embodiment of the present invention, showing a longitudinal cross-sectional view of a state in which a pressing head is pushed down.

From this state, when the restriction member 63 is separated and the pressing head 14 is pushed down to resist an elastic force of the coil spring 45 (see FIG. 1), as shown in FIG. 9, in a state in which the positions in the upward and downward directions of the piston for air 16 are constantly maintained, the mounting tube section 22 and the stem 12 are lowered, and a gap is formed between the lower end of the inner tube 31 of the piston for air 16 and the flange section 48 of the stem 12. Further, when the pressing head 14 is further pushed down, the upper edge of the inner tube 31 and the inner surface of the mounting tube section 22 approach and abut each other, and the piston for air 16 is lowered together with the stem 12.

In addition, here, the outer tube section 23 is also lowered as the pressing head 14 is pushed down, and for example, the piston member 55 is lowered together with the outer tube section 23 by the frictional force or the like applied between the outer tube section 23 and the tapered section 66*a*. The piston member 55 is lowered while the seal protrusion section 74 is air-tightly slid on the outer circumferential surface of the inner sliding tube 67. When the piston member 55 is lowered until the connecting section 68 abuts the upper end surface of the piston tube 8, the through-hole 72 is closed by the upper end surface of the piston tube 8, and communication between the inside of the head-section-side cylinder for air 54 and the outside through the introduction path 77 is blocked.

In a state in which the communication between the inside of the head-section-side cylinder for air 54 and the outside is blocked, when the pressing head 14 is further pushed down and the piston for air 16 is lowered, the air in the lower chamber disposed below the piston for air 16 is compressed in the cylinder for air 17. Accordingly, the air in the lower chamber flows into the air passage R1 from the gap between the lower end of the inner tube 31 and the flange section 48 to be conveyed into the air-liquid mixing chamber 20.

In addition, here, when the pressing head 14 is pushed down to lower the outer tube section 23 and the piston member 55 is slid in the head-section-side cylinder for air 54, the air in the upper chamber disposed over the piston member 55 is also compressed in the head-section-side cylinder for air 54. Accordingly, the air in the upper chamber flows into the air passage R1 from the gap between the lower end of the inner tube 31 and the flange section 48 through the communication path R2 and the inside of the cylinder for air 17 to be conveyed into the air-liquid mixing chamber 20.

Further, in a state in which the connecting section 68 abuts the upper end surface of the piston tube 8, the first through-hole 65 and the second through-hole 69 are in communication with each other, and the space disposed over the piston for air 16 in the cylinder for air 17 is in communication with the outside through the first through-hole 65 and the second through-hole 69. The space is in communication with the inside of the container main body 1 through a communication hole 78 formed in the cylinder for air 17.

When the pushing down of the pressing head 14 is released, after the stem 12 and the pressing head 14 are raised by the elastic recovery force of the coil spring 45 and the flange section 48 of the stem 12 abuts the lower end section of the inner tube 31 of the piston for air 16, the piston for air 16 is also further raised. In this example, as the inside of the lower chamber and the inside of the upper chamber are expanded to have a negative pressure, a frictional force is applied between the outer tube section 23 and the tapered section 66*a*, or the like, the piston member 55 is also raised. The piston member 55 is raised until the first engagement protrusion 64 and the second engagement protrusion 70 are engaged and returned to the position of the standby state.

Then, when the pressing head 14 and the piston for air 16 are raised together with the stem 12, as shown in FIG. 8, the external air flows into the head-section-side cylinder for air 54 through the introduction path 77, and the external air flows into the cylinder for air 17 through the inside of the head-section-side cylinder for air 54 and the communication path R2. As described above, the through-hole 72 opens when the pressing head 14 is pushed down and closes when the pushing down is released as the member configured to define the cylinder for air 17, the head-section-side cylinder for air 54 and the communication path R2 to be vertically movably linked to the pressing head 14.

In the foam discharge device 10''' of the above fourth embodiment, since the external air can flow into the cylinder for air 17 and the head-section-side cylinder for air 54 when the push down of the pressing head 14 is released without using the air hole 34 or the valve body 36 described in the first embodiment, the structure can be simplified and reduced in size.

Hereinabove, while embodiments of the foam discharge device according to the present invention have been described, the present invention is not limited to the above-mentioned embodiments but modifications may be made without departing from the spirit of the present invention.

For example, in the first to third embodiments, while the piston member 55 is installed at the upper end section of the piston tube 8 and they constitute the piston tube section 61, the piston tube 8 may be fitted into the head-section-side cylinder for air 54 without installing the piston member 55. In addition, in the first to third embodiments, while the configuration in which the head-section-side cylinder for air 54 is formed by the cylinder division tube 53 and the outer tube section 23 has been described, the head-section-side cylinder for air may be constituted by the mounting tube section 22 and the outer tube section 23.

In addition, in the embodiments, while the configuration in which the mounting cap 4 is threadedly engaged with the mouth section 2 has been described, the mounting cap 4 may be mounted on the mouth section 2 by capping.

INDUSTRIAL APPLICABILITY

The present invention provides the foam discharge device capable of sufficiently securing an air volume supplied into the air-liquid mixing unit even when mounted on the container main body provided with the mouth section having a small diameter.

REFERENCE SIGNS LIST

1 container main body
2 mouth section
4 mounting cap
6 ceiling wall section
8 piston tube (piston tube section)
10, 10', 10'', 10''' foam discharge device
11 pump
12 stem
13 nozzle hole
14 pressing head
16 piston for air
17 cylinder for air
18 piston for liquid
19 cylinder for liquid

20 air-liquid mixing chamber (air-liquid mixing unit)
21 foaming member (air-liquid mixing unit)
54 head-section-side cylinder for air
55 piston member (piston tube section)
58, 72 through-hole
R2 communication path
M air-liquid mixing unit

The invention claimed is:

1. A foam discharge device comprising:

a pump having a stem downwardly movably erected at a mouth section of a container main body in which a liquid is accommodated in an upwardly biased state, and a pressing head disposed at an upper end section of the stem and in which a nozzle hole is formed; and a mounting cap configured to mount the pump on the mouth section of the container main body, and configured to foam and discharge the liquid in the container main body from the nozzle hole, wherein the pump is provided with:

a piston for a liquid linked to the stem;

a cylinder for a liquid in which the piston for a liquid is vertically slidably accommodated;

a piston for air linked to the stem;

a cylinder for air in which the piston for air is vertically slidably accommodated; and an air-liquid mixing unit configured to mix a liquid from the cylinder for a liquid and air from the cylinder for air to foam the liquid, the cylinder for air is disposed inside the mounting cap and accommodated in the container main body, a head-section-side cylinder for air into which a piston tube section erected at a ceiling wall section of the mounting cap is vertically slidably fitted extends from the pressing head, and a communication path configured to bring the inside of the head-section-side cylinder for air and the inside of the cylinder for air in communication with each other is formed at the pump, wherein the pump is configured to supply the air in the head-section-side cylinder for air into the air-liquid mixing unit through the communication path when the pressing head is pushed down, the pressing head is provided with an outer tube section extending downward and dividing the head-section-side cylinder for air, and the piston tube section comprises a piston member having an outer circumferential edge vertically slidably fitted into an inner circumferential edge of the outer tube section.

2. The foam discharge device according to claim 1, wherein a through-hole through which external air is able to be supplied into the cylinder for air, the head-section-side cylinder for air and the communication path is formed in the pump, the through-hole opens in a standby state before the pressing head is pushed down, and closes as members that constitute the pump abut each other when the pressing head is pushed down, and the pressing head is configured to be pushed down in a state in which the through-hole is closed.

3. The foam discharge device according to claim 2, wherein the pump is configured that external air flows into the cylinder for air from the through-hole through the communication path, and external air flows into the head-section-side cylinder for air from the through-hole through the communication path.

4. The foam discharge device according to claim 3, wherein the piston tube section comprises:

a piston tube which is erected at the inner circumferential edge section of the ceiling wall section, and the piston member is slid in the head-section-side cylinder for air.

5. The foam discharge device according to claim 2, wherein the piston tube section comprises:

a piston tube which is erected at the inner circumferential edge section of the ceiling wall section, and the piston member is slid in the head-section-side cylinder for air.

6. The foam discharge device according to claim 1, wherein the piston tube section comprises:

a piston tube which is erected at the inner circumferential edge section of the ceiling wall section, and the piston member is slid in the head-section-side cylinder for air.

7. A foam discharge device comprising:

a pump having a stem downwardly movably erected at a mouth section of a container main body in which a liquid is accommodated in an upwardly biased state, and a pressing head disposed at an upper end section of the stem and in which a nozzle hole is formed; and a mounting cap configured to mount the pump on the mouth section of the container main body, and configured to foam and discharge the liquid in the container main body from the nozzle hole, wherein the pump is provided with:

a piston for a liquid linked to the stem;

a cylinder for a liquid in which the piston for a liquid is vertically slidably accommodated;

a piston for air linked to the stem;

a cylinder for air in which the piston for air is vertically slidably accommodated; and an air-liquid mixing unit configured to mix a liquid from the cylinder for a liquid and air from the cylinder for air to foam the liquid, the cylinder for air is disposed inside the mounting cap and accommodated in the container main body, a head-section-side cylinder for air into which a piston tube section erected at a ceiling wall section of the mounting cap is vertically slidably fitted extends from the pressing head, and a communication path configured to bring the inside of the head-section-side cylinder for air and the inside of the cylinder for air in communication with each other is formed at the pump, wherein the pump is configured to supply the air in the head-section-side cylinder for air into the air-liquid mixing unit through the communication path when the pressing head is pushed down, a through-hole through which external air is able to be supplied into the cylinder for air, the head-section-side cylinder for air and the communication path is formed in the pump, the through-hole opens in a standby state before the pressing head is pushed down, and closes as members that constitute the pump abut each other when the pressing head is pushed down, and the pressing head is configured to be pushed down in a state in which the through-hole is closed.

8. The foam discharge device according to claim 7, wherein the pump is configured that external air flows into the cylinder for air from the through-hole through the communication path, and external air flows into the head-section-side cylinder for air from the through-hole through the communication path.

9. The foam discharge device according to claim 8, wherein the piston tube section comprises:

a piston tube which is erected at the inner circumferential edge section of the ceiling wall section; and a piston member which is slid in the head-section-side cylinder for air.

10. The foam discharge device according to claim 7, wherein the piston tube section comprises:

a piston tube which is erected at the inner circumferential edge section of the ceiling wall section; and a piston member which is slid in the head-section-side cylinder for air.

* * * * *